US010772417B2

(12) United States Patent
Lavezzo et al.

(10) Patent No.: US 10,772,417 B2
(45) Date of Patent: Sep. 15, 2020

(54) ORAL CLEANING DEVICE WITH ADJUSTABLE SHAPE AND ORAL CLEANING METHOD

(71) Applicant: KONINKLIJKE PHILIPS N.V., Eindhoven (NL)

(72) Inventors: Valentina Lavezzo, Heeze (NL); Milica Kovacevic Milivojevic, Eindhoven (NL); Eduard Gerard Marie Pelssers, Panningen (NL); Daan Anton Van Den Ende, Breda (NL); Franciscus Johannes Gerardus Hakkens, Eersel (NL); Cornelis Petrus Hendriks, Eindhoven (NL); Mark Thomas Johnson, Arendonk (BE); Roland Alexander Van De Molengraaf, Geldrop (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 110 days.

(21) Appl. No.: 15/562,566

(22) PCT Filed: Mar. 22, 2016

(86) PCT No.: PCT/EP2016/056201
§ 371 (c)(1),
(2) Date: Sep. 28, 2017

(87) PCT Pub. No.: WO2016/156098
PCT Pub. Date: Oct. 6, 2016

(65) Prior Publication Data

US 2018/0103747 A1 Apr. 19, 2018

(30) Foreign Application Priority Data

Mar. 31, 2015 (EP) ..... 15161945
Dec. 9, 2015 (EP) ..... 15198563

(51) Int. Cl.
*A46B 7/06* (2006.01)
*A46B 7/02* (2006.01)
(Continued)

(52) U.S. Cl.
CPC ..... *A46B 7/06* (2013.01); *A46B 5/007* (2013.01); *A46B 5/0025* (2013.01); *A46B 7/023* (2013.01);
(Continued)

(58) Field of Classification Search
CPC .... A46B 7/02; A46B 7/00; A46B 7/06; A46B 9/10; A46B 5/002; A46B 5/0025;
(Continued)

(56) References Cited

U.S. PATENT DOCUMENTS 4,335,731 A 6/1982 Bora
5,500,970 A 3/1996 Maurer et al.
(Continued)

FOREIGN PATENT DOCUMENTS

CN 85106802 A 3/1987
CN 102272174 A 12/2011
(Continued)

OTHER PUBLICATIONS

English translation of DE 102005012376 A1, published Apr. 24, 2008.*
(Continued)

*Primary Examiner* — Laura C Guidotti

(57) ABSTRACT

An oral cleaning device comprises a body which carries a set of projections. An actuator device is associated with one or more of the projections in the form of an electroactive polymer structure for adjusting a position of the associated one or more projections. This enables dynamic control of the cleaning function.

21 Claims, 5 Drawing Sheets

(51) Int. Cl.
*A46B 9/10* (2006.01)
*A46B 5/00* (2006.01)
*A46B 9/04* (2006.01)

(52) U.S. Cl.
CPC ..... *A46B 9/04* (2013.01); *A46B 9/10* (2013.01); *A46B 2200/1066* (2013.01)

(58) Field of Classification Search
CPC ..... A46B 5/0029; A46B 5/0033; A46B 5/007; A46B 5/570075; A46B 15/0006; A46B 15/0012; A46B 9/04; A46B 7/023; H01L 41/042; H01L 41/193; H01L 41/1132
See application file for complete search history.

(56) References Cited

U.S. PATENT DOCUMENTS

| | | | | |
|---|---|---|---|---|
| 5,876,207 | A * | 3/1999 | Sundius | A46B 15/0002 15/105 |
| 2007/0006410 | A1 | 1/2007 | Kraemer | |
| 2009/0001855 | A1 | 1/2009 | Alireza | |
| 2013/0025079 | A1 | 1/2013 | Jungnickel et al. | |
| 2014/0014403 | A1 | 1/2014 | Miller et al. | |
| 2014/0180089 | A1 | 6/2014 | Alpert et al. | |
| 2016/0310248 | A1 * | 10/2016 | Meerbeek | A46B 7/02 |
| 2016/0317267 | A1 * | 11/2016 | Meerbeek | A46B 15/0004 |

FOREIGN PATENT DOCUMENTS

| | | | | |
|---|---|---|---|---|
| CN | 103876450 | A | 6/2014 | |
| DE | 102005012376 | A1 * | 4/2008 | A46B 15/0002 |
| EP | 0173114 | A | 3/1986 | |
| JP | 717133 | U | 3/1995 | |
| JP | 2009291316 | A | 12/2009 | |
| WO | 2010020960 | A1 | 2/2010 | |
| WO | 2010077465 | A1 | 7/2010 | |
| WO | 2013183018 | A1 | 12/2013 | |
| WO | 2014098948 | A1 | 6/2014 | |

OTHER PUBLICATIONS

"Electro-Active Polymer Actuators and Sensors-Types, Applications, New Developments, Industry Structure and Global Markets";iRAP (Innovative Research and Products, Inc.), Mar. 2013, Downloaded from http://www.innoresearch.net/report_summary.aspx?id=83&pg=129&rcd=ET-116&pd=3/1/2013, on Jan. 6, 2015, 4 Page Document.

* cited by examiner

ORAL CLEANING DEVICE WITH ADJUSTABLE SHAPE AND ORAL CLEANING METHOD

CROSS-REFERENCE TO PRIOR APPLICATIONS

This application is the U.S. National Phase application under 35 U.S.C. § 371 of International Application No. PCT/EP2016/056201, filed on Mar. 22, 2016, which claims the benefit of European Patent Application No. 15161945.9, filed on Mar. 31, 2015 and European Patent Application No. 15198563.7, filed on Dec. 9, 2015. These applications are hereby incorporated by reference herein.

FIELD OF THE INVENTION

This invention relates to oral cleaning devices, such as toothbrushes.

BACKGROUND OF THE INVENTION

Every toothbrush (manual or electric) has a head with a set of tufts, and each tuft typically comprises a bundle of bristles.

Typical rectangular tufted brushes have 5 or 6 tufts along their length and 2 or 3 tufts across their width. There are designs with a greater density of tufts, such as 10 to 12 tufts in length and 3 to 4 tufts in width. By arranging the tufts closer together, the bristles may be able to get between and around gums better because the bristles are closer together.

There are also toothbrush designs with different length tufts. Some extra-long, high-density bristles form tufts that are used to to target hidden plaque caught deep between the teeth and to reach other hard-to-clean areas.

As plaque will never be completely removed from those hard to reach areas, there is a need to adjust toothbrush designs towards improved plaque removing performance.

Other oral cleaning devices exist which make use of bristles or tufts for cleaning the teeth, gums or tongue. There is a need for improved cleaning performance in oral cleaning devices generally.

SUMMARY OF THE INVENTION

It is an object of the invention to at least partially fulfill the aforementioned need. This object is achieved with the invention as defined by the independent claims. The dependent claims provide advantageous embodiments.

According to examples in accordance with an aspect of the invention, there is provided an oral cleaning device comprising:

a body which carries a set of projections;

an actuator device associated with a sub-set of one or more of the projections and provided at the base of the one or more projections, wherein the actuator device comprises an electroactive polymer structure which deforms in response to a drive signal applied to the actuator device thereby to adjust a position of the associated one or more projections.

This device is able to adapt its shape (in particular the contour defined by the ends of the projections) during use, in particular so that projections are advanced to assist in the cleaning of difficult-to-reach areas. The adjustment may for example be controlled based on a feedback control. The profile adjustment may be used for controlling the pressure applied by the ends of the projections and/or the contour.

Only a sub-set of the projections is associated with the actuator. In this way, the shape of the surface envelope of the projections is changed at the level of the individual projections. In this way, the contour is actively changed to provide a dynamic cleaning effect. At the limit there may be one actuator for driving one projection or one set of projections. Each projection may be a single relatively thick element, or it may be a cluster of relatively thin bristles.

The body which carries the projections is for example generally planar and the projections from that body may then extend in essentially the same parallel direction (i.e. like a toothbrush). Each sub-set of projections is over a portion of the overall area of the body.

The device may have a set of actuators, each associated with a respective projection or set of projections. This enables the shape of the overall envelope of the set of projections to be controlled more accurately.

There may be between 1 and 5 actuators, and each actuator may for example be associated with 1 to 5 projections (as defined above).

The projections may comprise a first sub-set of a first length and a second sub-set of a second, shorter, length, wherein at least some of the first sub-set of projections have an associated actuator device. The actuator is thus used to advance the deepest projections, so they may advance further to the gums or between the teeth while other projections are at the tooth surface.

The actuator device may be adapted to perform force sensing in one mode of operation and to perform force application in another mode of operation. In this way, the device may sense when a projection should be advanced, for example if there is no external force applied. The force sensing and actuation may be performed time-sequentially.

Alternatively, a separate force sensor device may be associated with one or more of the projections and provided at the base of the one or more projections. In this way, the force sensing and actuation may be applied at the same time.

The force sensor device may also comprise an electroactive polymer structure which generates a sensor signal in response to an applied force. The device then has separate sensor and actuator arrangements.

The force sensor device and the actuator device may for example be stacked one above the other.

A sealing arrangement may be provided for protecting the or each electroactive polymer structure. This is particularly desirable for an oral cleaning product.

In a first arrangement, the device comprises a base, and a cover part over the base with openings for the projections, wherein the or each electroactive polymer structure is between the base and the cover.

A first possible sealing arrangement then comprises a flexible sealing layer around the or each electroactive polymer structure to which the associated projections are bonded.

A second possible sealing arrangement comprises a sealing layer around the projections where they pass through the openings of the cover part.

The invention is of particular interest for a toothbrush head. The toothbrush head may be part of a mechanical toothbrush (with a head which is moved only by the user) or part of an electric toothbrush (with a head to which cyclic movements are applied electrically).

A system may be formed of multiple devices as defined above, each with a respective body and set of projections, for example with the bodies oriented differently to face different surfaces of a tooth or the gums.

The invention also provides an oral cleaning method comprising:

adjusting a position of one or more projections of an oral cleaning device using an actuator device provided at the base of a sub-set of the one or more projections, which actuator device comprises an electroactive polymer structure which deforms in response to a drive signal applied to the actuator device.

This method provides active control of the contour of a cleaning device by adjusting the position of the projections while a cleaning operation is being carried out.

The method preferably further comprises sensing a force applied to the one or more projections and controlling the position adjusting in response to the sensing. This provides a dynamic control approach using feedback to control the required position adjustment.

Each projection may comprise a single projecting part, or it may comprise a set of bristles.

BRIEF DESCRIPTION OF THE DRAWINGS

Examples of the invention will now be described in detail with reference to the accompanying drawings, in which.

DETAILED DESCRIPTION OF THE EMBODIMENTS

The invention provides an oral cleaning device comprising a body which carries a set of projections. An actuator device is associated with one or more of the projections in the form of an electroactive polymer structure for adjusting a position of the associated one or more projections. This enables dynamic control of the cleaning function.

The invention provides an oral cleaning device in which there is control of the projection position using an electroactive polymer (EAP) actuator. The EAP technology which may be employed will first be explained.

Electroactive polymers (EAPs) are an emerging class of materials within the field of electrically responsive materials. EAP's can work as sensors or actuators and can easily be manufactured into various shapes allowing easy integration into a large variety of systems.

Materials have been developed with characteristics such as actuation stress and strain which have improved significantly over the last ten years. Technology risks have been reduced to acceptable levels for product development so that EAPs are commercially and technically becoming of increasing interest. Advantages of EAPs include low power, small form factor, flexibility, noiseless operation, accuracy, the possibility of high resolution, fast response times, and cyclic actuation.

The improved performance and particular advantages of EAP material give rise to applicability to new applications.

An EAP device can be used in any application in which a small amount of movement of a component or feature is desired, based on electric actuation. Similarly, the technology can be used for sensing small movements.

The use of EAPs enables functions which were not possible before, or offers a big advantage over common sensor/actuator solutions, due to the combination of a relatively large deformation and force in a small volume or thin form factor, compared to common actuators. EAPs also give noiseless operation, accurate electronic control, fast response, and a large range of possible actuation frequencies, such as 0-20 kHz.

Devices using electroactive polymers can be subdivided into field-driven and ionic-driven materials.

Examples of field-driven EAPs are dielectric elastomers, electrostrictive polymers (such as PVDF based relaxor polymers or polyurethanes) and liquid crystal elastomers (LCE).

Examples of ionic-driven EAPs are conjugated polymers, carbon nanotube (CNT) polymer composites and Ionic Polymer Metal Composites (IPMC).

Field-driven EAP's are actuated by an electric field through direct electromechanical coupling, while the actuation mechanism for ionic EAP's involves the diffusion of ions. Both classes have multiple family members, each having their own advantages and disadvantages.

Figure 1:
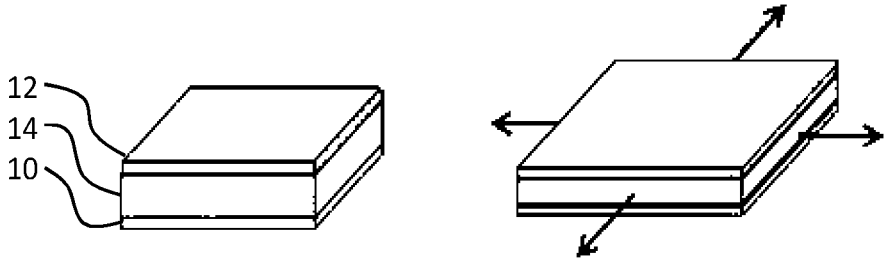
FIG. 1 shows a known electroactive polymer device which is not clamped.
Figure 2:
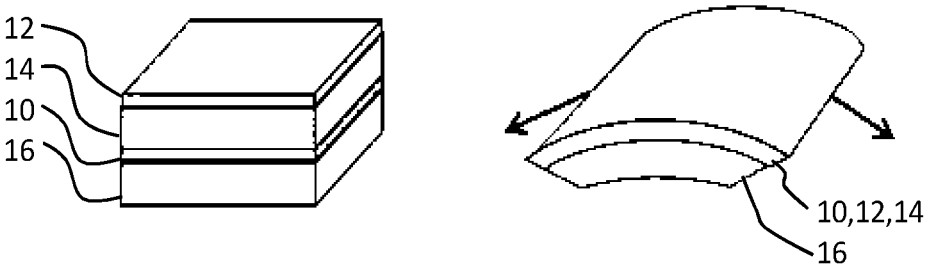
FIG. 2 shows a known electroactive polymer device which is constrained by a backing layer.

FIGS. 1 and 2 show two possible operating modes for an EAP device.

The device comprises an electroactive polymer layer 14 sandwiched between electrodes 10, 12 on opposite sides of the electroactive polymer layer 14.

FIG. 1 shows a device which is not clamped. A voltage is used to cause the electroactive polymer layer to expand in all directions as shown.

FIG. 2 shows a device which is designed so that the expansion arises only in one direction. The device is supported by a carrier layer 16. A voltage is used to cause the electroactive polymer layer to curve or bow.

Together, the electrodes, electroactive polymer layer, and carrier will be termed an "electroactive polymer structure".

The nature of this movement for example arises from the interaction between the active layer which expands when actuated, and the passive carrier layer. To obtain the asymmetric curving around an axis as shown, molecular orientation (film stretching) may for example be applied, forcing the movement in one direction.

The expansion in one direction may result from the asymmetry in the EAP polymer, or it may result from asymmetry in the properties of the carrier layer, or a combination of both.

The examples below are based on a toothbrush head, with projections in the form of tufts, each tuft comprising a set of bristles.

Figure 3:
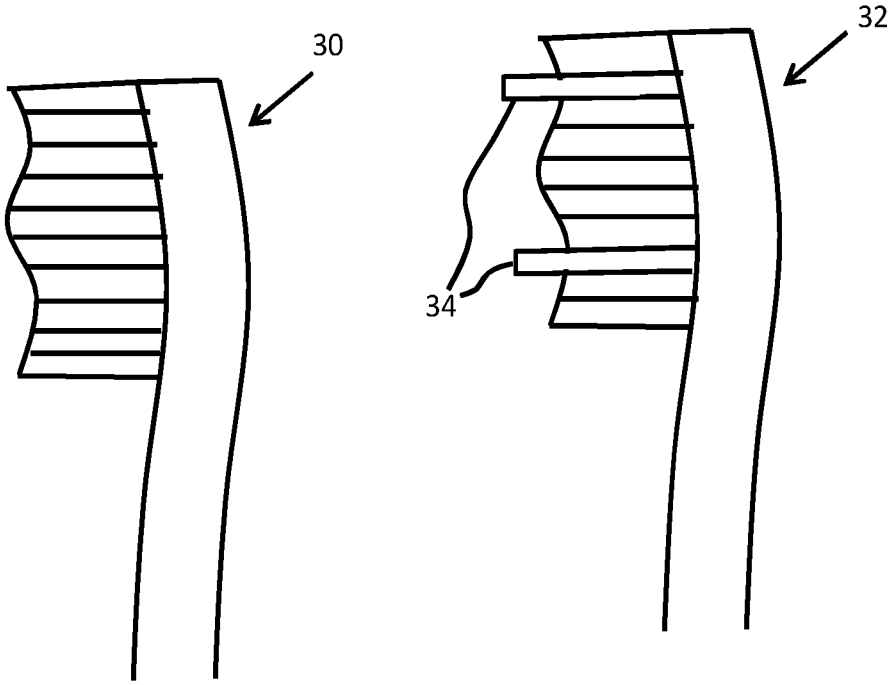
FIG. 3 shows two possible tuft profiles for a toothbrush head.

The left part of FIG. 3 shows a toothbrush head 30 with tufts of different length in order to define a contour which matches the shape of the teeth. The right part shows a toothbrush head 32 with some extra-long tufts 34 which are intended to reach up to the gum line or between the teeth when the other tufts are at the tooth surface.

While these static approaches improve the cleaning efficiency, they do not take account of the differences between different users.

Figure 4:
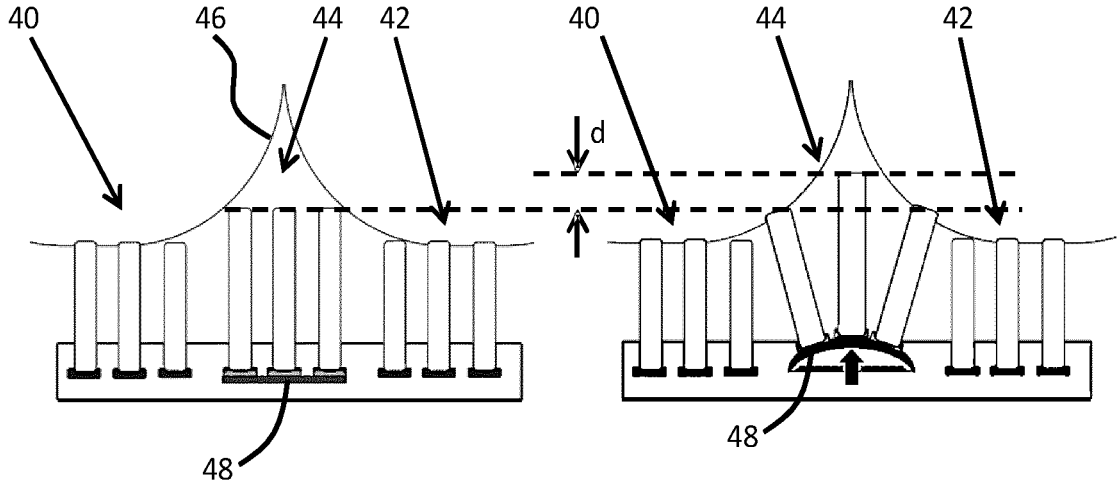
FIG. 4 shows a first example of EAP controlled toothbrush head.

FIG. 4 shows how an EAP actuator may be used to provide adjustment of the tuft position. This may either be to provide a cyclic adjustment to assist the cleaning performance, or it may be to provide adjustments which take account of the particular user.

FIG. 4 shows a row of tufts in the length direction of the toothbrush head.

A first sub-set 40 of three tufts and a second sub-set 42 of three tufts are relatively short, and a third sub-set 44 are relatively long, and are intended to reach into the space between teeth 46.

The sub-set 44 is mounted on an actuator device 48 in the form of an EAP device. The left image shows the non-actuated position, and the right image shows the actuated position. The actuator bends outwardly to change the position of the tufts. The central tuft is raised outwardly, and tufts to the side are raised and steered outwardly as shown.

By operating the actuator 48 using a periodic drive signal, the tufts can be made to vibrate towards and away from the teeth. This direction of movement is more difficult for a user to achieve manually. The penetration depth into the spaces between teeth is increased by the amount shown as d.

The EAP actuator may be operated cyclically at all times while the device is in use. In this way, the vibrating motion is used to assist the cleaning function. However, the actuation may be controlled using sensing feedback. For example, a pressure sensor may be coupled to the tufts to be controlled. If the normal-direction pressure on a tuft is reduced, the EAP actuator is used to advance the tuft further away from the cleaning head, into the interproximal space between teeth. In this way, bristles will follow the teeth contour and better clean deeper in the interproximal space and along the gum line.

When moving further away from the interproximal space toward the next tooth, the tuft can then be retracted by bringing EAP actuator back to the starting position.

The sensing for feedback control may use separate pressure sensors at the base of the tufts.

Such sensors could include piezoresistive or capacitive pressure sensors. The sensors can consist of pressure sensitive materials such as piezoresistive rubbers or deformable elastomer capacitors. Alternatively the sensors can be based on membrane technology such as deformable polymer membranes with metal electrodes or micro machined silicon sensors.

An EAP device may be used as a pressure sensor. The external force applied to the EAP device alters the electromagnetic field which can then be detected.

For example, there may be a stack of an EAP sensor and an EAP actuator (in either order). With the actuator on top, the sensor will detect the force being applied through the actuator. With the actuator on the bottom, the sensor will more directly detect the force applied.

Different combinations of tuft may have the EAP actuator applied. The actuator may be associated with an individual tuft or with groups of tufts. Various examples are shown in FIGS. 5 to 8. As a further example, the EAP actuator may cover the whole brush area (i.e. all tufts). This is the simplest implementation although it does not allow any independent control of different tufts or groups of tufts.

Figure 5:
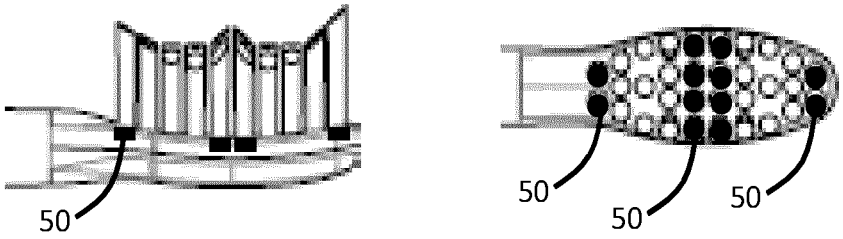
FIG. 5 shows a second example of EAP controlled toothbrush head.

FIG. 5 shows an example in which a set of individual tufts each have their own combined pressure sensor and force actuator 50. In this example the actuated tufts define rows extending across the toothbrush head. These rows are typically aligned with the space between adjacent teeth during brushing. As shown in FIG. 5, the actuators are applied to the longer tufts which are intended to reach into the spaces between teeth. When brushing perpendicularly to the line of the teeth, these longer tufts may then instead reach to the gum line.

Figure 6:
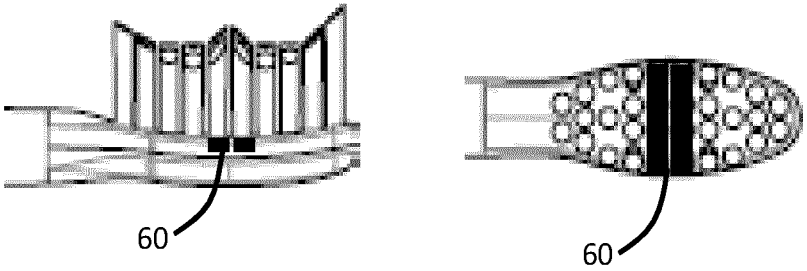
FIG. 6 shows a third example of EAP controlled toothbrush head.

FIG. 6 shows an example in which two lateral rows of tufts are again actuated but this time using a shared EAP actuator and sensor device 60 for each row.

Figure 7:
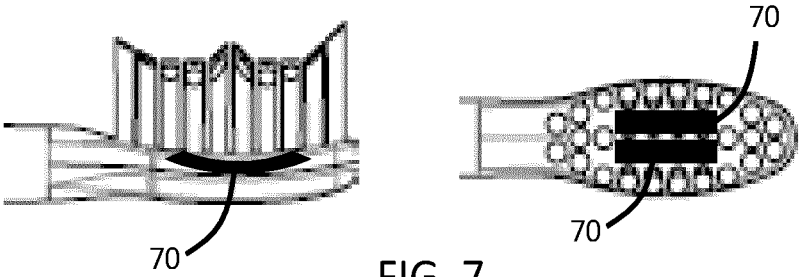
FIG. 7 shows a fourth example of EAP controlled toothbrush head.

FIG. 7 shows an example in which two longitudinal rows of tufts are actuated each with a shared EAP actuator and sensor device 70. Each row is only a portion of the full row of tufts of the toothbrush head. These longitudinal rows extend in the direction corresponding to typical movement of the toothbrush along the tooth surface during brushing.

Figure 8:
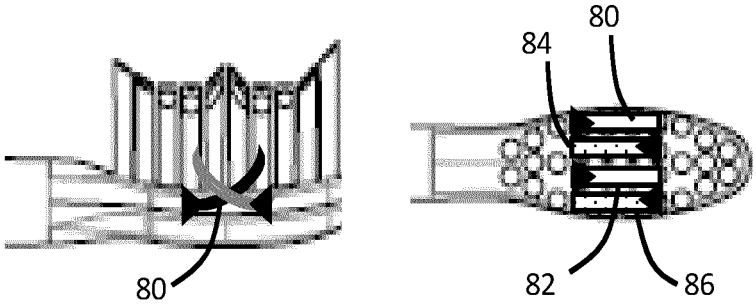
FIG. 8 shows a fifth example of EAP controlled toothbrush head.

FIG. 8 shows an example in which four longitudinal rows of tufts are actuated each with a shared EAP actuator and sensor device. The alternate actuators have different designs. In particular, actuators 80 and 82 are clamped at one end, so that the deformation of the actuators is asymmetric. Actuators 84 and 86 are clamped at the other end, so that the deformation of the actuators is asymmetric in the opposite direction. This induces a sort of twisting movement of the tufts relative to each other, and may provide a form of scraping function to improve the cleaning efficiency.

As a mouth is a very humid working environment, the EAP stack is preferably sealed to avoid its exposure to liquids and moisture. This may for example be achieved by embedding the actuator (and sensor if used) in a water-resistant compliant material, that will not substantially damp the deformation and will not substantially prevent transfer of motion through the seal.

Various sealing arrangements will now be described with reference to FIGS. 9 to 11. These show a cross section across the width of the toothbrush head. For the purposes of explanation, a widthwise row of tufts is shown with a shared actuator (as in FIG. 6). However, the general sealing approaches can of course be applied to other configurations. The same sealing arrangements may of course also be applied to individual projections instead of tufts formed as a set of bristles.

Figure 9:
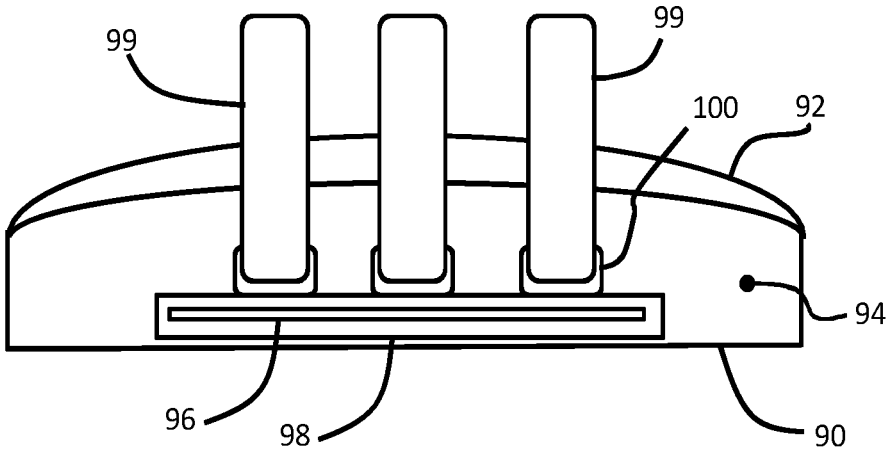
FIG. 9 shows a sixth example of EAP controlled toothbrush head.

As shown in FIG. 9, the toothbrush head has a base 90 and a cover part 92. The cover part is sealed to the base so that a cavity 94 is formed which contains the actuator (and sensor if used). The same basic head structure is also used in FIGS. 10 and 11.

In the example of FIG. 9, the electroactive polymer structure 96 (forming the actuator and optionally also the sensor) is surrounded by a flexible sealing layer 98. The associated tufts 99 are bonded to that sealing layer by adhesive 100.

Figure 10:
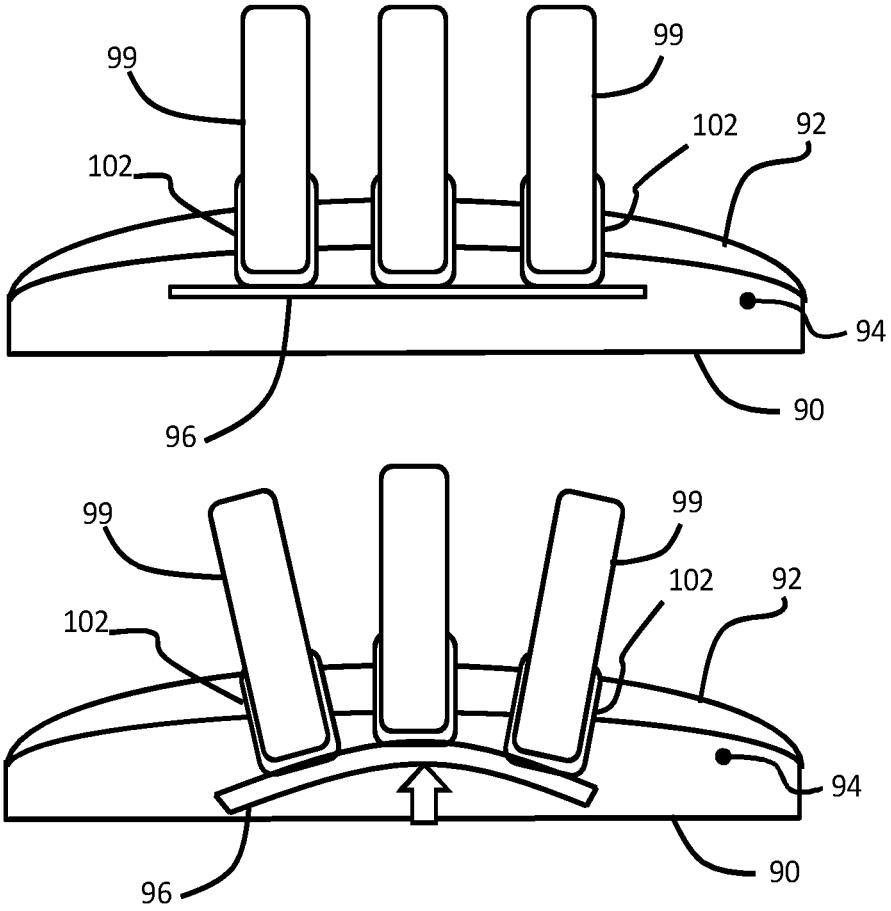
FIG. 10 shows a seventh example of EAP controlled toothbrush head.

In the example of FIG. 10, the sealing arrangement comprises a sealing layer 102 around the tufts where they pass through openings of the cover part 92. The sealing layer extends to the base of the tufts and additionally provides the bonding of the tufts to the EAP actuator 96. FIG. 10 shows the design in the non-actuated and in the actuated states.

Figure 11:
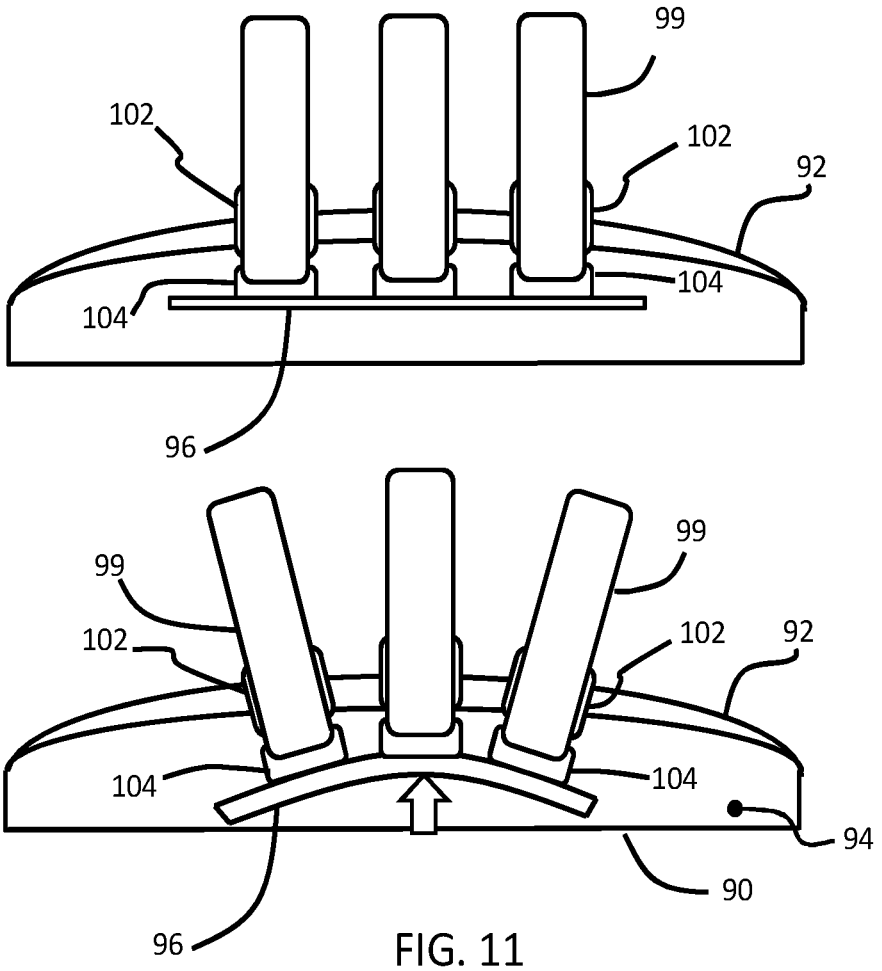
FIG. 11 shows an eighth example of EAP controlled toothbrush head.

In the example of FIG. 11, the sealing arrangement again comprises a sealing layer 102 around the tufts where they pass through openings of the cover part 92. There is a separate bonding 104 of the tufts to the EAP actuator 96.

There are various possible designs for the EAP actuator and EAP sensor (when a sensor is used). The electrode arrangement may for example comprise electrodes on opposite faces of the electroactive polymer layer as shown above, for a field driven device. These provide a transverse electric field for controlling the thickness of the EAP layer. This in turn causes expansion or contraction of the EAP layer in the plane of the layer.

The electrode arrangement may instead comprise a pair of comb electrodes on one face of the electroactive polymer layer. This provides an in-plane electric field, for directly controlling the dimensions of the layer in-plane.

Figure 12:
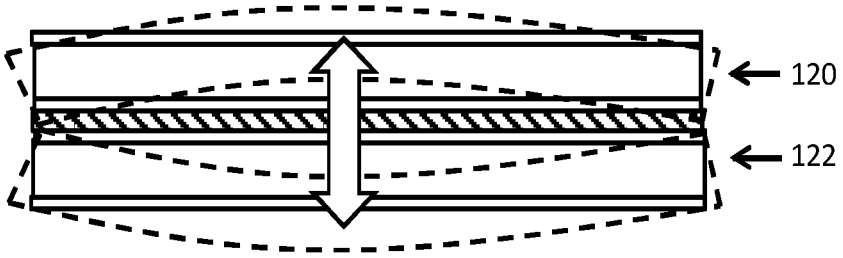
FIG. 12 shows two EAP actuators which are stacked to enable bidirectional driving to create convex and concave profiles.

The actuators shown above deform in a single direction. Double sided EAP actuators are also known which are able to deform in opposite directions. A double sided actuator may be used to able the profile to be driven from concave to convex, which a flat rest state between. FIG. 12 shows an actuator comprising a stack of two EAP devices 120,122, which deform in opposite directions when actuated as shown by the dotted curved outlines.

Figure 13:
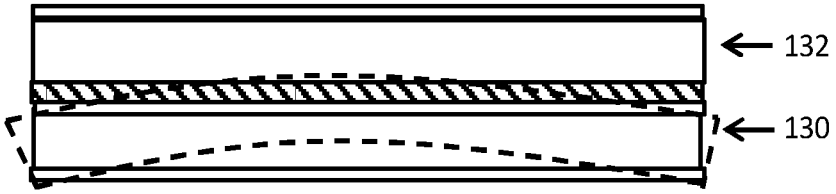
FIG. 13 shows an EAP actuator stacked on a pressure sensor.

For completeness FIG. 13, shows an EAP actuator 130 stacked beneath a pressure sensor 132. The pressure sensor may be an EAP sensor device or it may be another type of pressure sensor. It is used to provide a feedback signal for use in the control of the actuator 130.

Materials suitable for the EAP layer are known. Electroactive polymers include, but are not limited to, the subclasses: piezoelectric polymers, electromechanical polymers, relaxor ferroelectric polymers, electrostrictive polymers, dielectric elastomers, liquid crystal elastomers, conjugated polymers, Ionic Polymer Metal Composites, ionic gels and polymer gels.

The sub-class electrostrictive polymers includes, but is not limited to:

Polyvinylidene fluoride (PVDF), Polyvinylidene fluoride-trifluoroethylene (PVDF-TrFE), Polyvinylidene fluoride-trifluoroethylene-chlorofluoroethylene (PVDF-TrFE-CFE), Polyvinylidene fluoride-trifluoroethylene-chlorotrifluoroethylene) (PVDF-TrFE-CTFE), Polyvinylidene fluoride-hexafluoropropylene (PVDF-HFP), polyurethanes or blends thereof.

The sub-class dielectric elastomers includes, but is not limited to:

acrylates, polyurethanes, silicones.

The sub-class conjugated polymers includes, but is not limited to:

polypyrrole, poly-3,4-ethylenedioxythiophene, poly(p-phenylene sulfide), polyanilines.

Additional passive layers may be provided for influencing the behavior of the EAP layer in response to an applied electric field.

The EAP layer may be sandwiched between electrodes as mentioned above. The electrodes may be stretchable so that they follow the deformation of the EAP material layer. Materials suitable for the electrodes are also known, and may for example be selected from the group consisting of thin metal films, such as gold, copper, or aluminum or organic conductors such as carbon black, carbon nanotubes, graphene, poly-aniline (PANI), poly(3,4-ethylenedioxythiophene) (PEDOT), e.g. poly(3,4-ethylenedioxythiophene) poly(styrenesulfonate) (PEDOT:PSS). Metalized polyester films may also be used, such as metalized polyethylene terephthalate (PET), for example using an aluminum coating.

The materials for the different layers will be selected for example taking account of the elastic moduli (Young's moduli) of the different layers.

Additional layers to those discussed above may be used to adapt the electrical or mechanical behavior of the device, such as additional polymer layers.

The EAP devices may be electric field driven devices or ionic devices. Ionic devices may be based on ionic polymer-metal composites (IPMCs) or conjugated polymers. An ionic polymer-metal composite (IPMC) is a synthetic composite nanomaterial that displays artificial muscle behavior under an applied voltage or electric field.

IPMCs are composed of an ionic polymer like Nafion or Flemion whose surfaces are chemically plated or physically coated with conductors such as platinum or gold, or carbon-based electrodes. Under an applied voltage, ion migration and redistribution due to the imposed voltage across a strip of IPMCs result in a bending deformation. The polymer is a solvent swollen ion-exchange polymer membrane. The field causes cations travel to cathode side together with water. This leads to reorganization of hydrophilic clusters and to polymer expansion. Strain in the cathode area leads to stress in rest of the polymer matrix resulting in bending towards the anode. Reversing the applied voltage inverts the bending.

If the plated electrodes are arranged in a non-symmetric configuration, the imposed voltage can induce all kinds of deformations such as twisting, rolling, torsioning, turning, and non-symmetric bending deformation.

The invention is of interest for micro-bristle actuation in oral cleaning devices generally, and not only toothbrush heads as discussed above. Other oral cleaning devices are tongue cleaners and mouthpieces.

A tongue cleaner is a device with bristles or sets of bristles which is used as part of a breath care system, for removing bad breath bacteria. It is used to break up a tongue coating, with bristles which penetrate around the papillae to remove debris. A single bristle or a group of bristles may make up a projection which is controlled by an associated EAP device.

A mouthpiece is a like a gum shield, and it is known for such devices to have vibrating projections on the inside which face the teeth. Such a device may function as a toothbrush and teether for infants, or else it may provide an alternative to a toothbrush for adults.

A system may be formed of multiple devices, each with a respective body and set of projections, for example with the bodies oriented differently to face different surfaces of a tooth or the gums. For example, a gum shield may have different bodies, and within each body there are actuators operating on a sub-set of the projections.

The projections, in the form of tufts of micro bristles or individual projections, can be actuated directly using EAPs as drivers as explained above. An array of EAPs may be used for switching between different settings for different parts and segments of the cleaning device head. For instance, this enables switching between pushing hard against the teeth or light brushing.

Other variations to the disclosed embodiments can be understood and effected by those skilled in the art in practicing the claimed invention, from a study of the drawings, the disclosure, and the appended claims. In the claims, the word "comprising" does not exclude other elements or steps, and the indefinite article "a" or "an" does not exclude a plurality. The mere fact that certain measures are recited in mutually different dependent claims does not indicate that a combination of these measured cannot be used to advantage. Any reference signs in the claims should not be construed as limiting the scope.

The invention claimed is:

1. An oral cleaning device comprising:

a body which carries a set of projections, the ends of the set of projections defining a contour of the oral cleaning device;

an actuator device associated with a sub-set of one or more of the projections, provided at a base of the one or more projections and located beneath the sub-set of the one or more projections, and wherein the actuator device comprises an electroactive polymer structure which is capable of deforming in response to a drive signal when applied to the actuator device thereby providing active control of the contour of the oral cleaning device by adjusting a position of the associated one or more projections.

2. A cleaning device as claimed in claim 1, comprising a plurality of actuator devices, each associated with a respective projection or set of projections.

3. A cleaning device as claimed in claim 1, wherein the projections comprise a first sub-set of a first length and a second sub-set of a second, shorter, length, wherein at least some of the first sub-set of projections have the actuator device provided at the base.

4. A cleaning device as claimed in claim 1, wherein the actuator device is adapted to perform force sensing in one mode of operation and to perform force application in another mode of operation.

5. A cleaning device as claimed in claim 1, further comprising a force sensor device associated with one or more of the projections and provided at the base of the one or more projections.

6. A cleaning device as claimed in claim 5, wherein the force sensor device comprises an electroactive polymer structure which generates a sensor signal in response to an applied force.

7. A cleaning device as claimed in claim 6, where the force sensor device and the actuator device are stacked one above the other.

8. A cleaning device as claimed in claim 1, comprising a sealing arrangement for protecting the electroactive polymer structure.

9. A cleaning device as claimed in claim 8, comprising a base, and a cover part over the base with openings for the projections, wherein the electroactive polymer structure is between the base and the cover.

10. A cleaning device as claimed in claim 9, wherein the sealing arrangement comprises a flexible sealing layer around the electroactive polymer structure to which the associated projections are bonded.

11. A cleaning device as claimed in claim 9, wherein the sealing arrangement comprises a sealing layer around the projections where they pass through the openings of the cover part.

12. A cleaning device as claimed in claim 1, wherein the body includes a toothbrush head.

13. An oral cleaning method comprising:

adjusting a position of one or more projections of an oral cleaning device using an actuator device provided at a base of a sub-set of the one or more projections and located beneath the sub-set of the one or more projections, and wherein the actuator device comprises an electroactive polymer structure which deforms in response to a drive signal applied to the actuator device thereby providing active control of a contour of the oral cleaning device.

14. A method as claimed in claim 13, wherein the method further comprises sensing a force applied to the one or more projections and controlling the position adjusting in response to the sensing.

15. A method as claimed in claim 13 comprises a tooth brushing method, and the oral cleaning device comprises a toothbrush head.

16. An oral cleaning device comprising:

a body which carries a set of projections, an actuator device associated with a sub-set of one or more of the projections and provided at a base of the one or more projections, wherein the actuator device comprises an electroactive polymer structure which is capable of deforming in response to a drive signal when applied to the actuator device thereby to adjust a position of the associated one or more projections; and wherein the actuator device is adapted to perform force sensing in one mode of operation and to perform force application in another mode of operation.

17. An oral cleaning device comprising:

a body which carries a set of projections, an actuator device associated with a sub-set of one or more of the projections and provided at a base of the one or more projections, wherein the actuator device comprises an electroactive polymer structure which is capable of deforming in response to a drive signal when applied to the actuator device thereby to adjust a position of the associated one or more projections; and a force sensor device associated with one or more of the projections and provided at the base of the one or more projections.

18. A cleaning device as claimed in claim 17, wherein the force sensor device comprises an electroactive polymer structure which generates a sensor signal in response to an applied force.

19. A cleaning device as claimed in claim 18, where the force sensor device and the actuator device are stacked one above the other.

20. An oral cleaning device comprising:

a body which carries a set of projections, an actuator device associated with a sub-set of one or more of the projections and provided at a base of the one or more projections, wherein the actuator device comprises an electroactive polymer structure which is capable of deforming in response to a drive signal when applied to the actuator device thereby to adjust a position of the associated one or more projections;

a sealing arrangement for protecting the electroactive polymer structure;

a base, and a cover part over the base with openings for the projections, wherein the electroactive polymer structure is between the base and the cover;

wherein the sealing arrangement comprises a flexible sealing layer around the electroactive polymer structure to which the associated projections are bonded; and wherein the sealing arrangement comprises a sealing layer around the projections where they pass through the openings of the cover part.

21. An oral cleaning method comprising:

adjusting a position of one or more projections of an oral cleaning device using an actuator device provided at a base of a sub-set of the one or more projections, which actuator device comprises an electroactive polymer structure which deforms in response to a drive signal applied to the actuator device; and sensing a force applied to the one or more projections and controlling the position adjusting in response to the sensing.

* * * * *